United States Patent [19]

Ramos, Jr.

[11] Patent Number: 4,760,715

[45] Date of Patent: Aug. 2, 1988

[54] RESILIENT WRIST BRACELET

[76] Inventor: Philip M. Ramos, Jr., 15315 Cornet Ave., Santa Fe Springs, Calif. 90670

[21] Appl. No.: 864,535

[22] Filed: May 19, 1986

[51] Int. Cl.[4] ..... A44C 5/04; A44C 5/00

[52] U.S. Cl. ..... 63/5.2; 63/3; 63/5.1

[58] Field of Search ..... 63/12, 13, 14, 3, 4, 63/5 A, 21, 23; 2/170; 224/219, 164, 165, 172, 175; D11/19, 20; 70/456 R

[56] References Cited

U.S. PATENT DOCUMENTS

| | | | |
|---|---|---|---|
| 80,676 | 8/1868 | Soule | 63/11 |
| 1,165,882 | 12/1915 | Killion | 70/456 R |
| 1,571,425 | 2/1926 | Mataloni | 70/459 |
| 3,124,286 | 3/1964 | Dompier | 63/1 R |
| 3,823,587 | 7/1974 | Tcherdakoff | 70/457 |

FOREIGN PATENT DOCUMENTS

| | | | |
|---|---|---|---|
| 1761 | of 0000 | Fed. Rep. of Germany | 63/6 |

*Primary Examiner*—Richard J. Johnson

*Assistant Examiner*—Michael Brown

*Attorney, Agent, or Firm*—John E. Wagner

[57] ABSTRACT

An improved wrist bracelet designed to carry a ring for supporting keys, as well as another connection designed to carry additional hanging objects and when not in use, be stored within the continuous coil of the bracelet body. The bracelet body itself is preferably fabricated from helically wound, perspiration impervious, attractive materials such as polyethylene plastic, having sufficient resiliency to allow the bracelet to be expanded sufficiently to be placed over the hand or foot and worn on the wrist or ankle.

The coil making up the body of the bracelet has its ends joined together in a crimped connector, having a perforated tab extension adapted to receive other hanging objects. The crimped connection and tab extension are dimensioned to have a maximum transverse dimension less than the internal diameter of the coils making up the bracelet body, whereby the interconnection member can be inserted within adjacent coils in order to keep it out of sight and out of way when not in use.

4 Claims, 1 Drawing Sheet

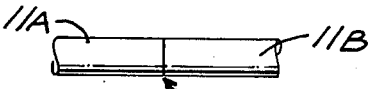
FIG. 1A
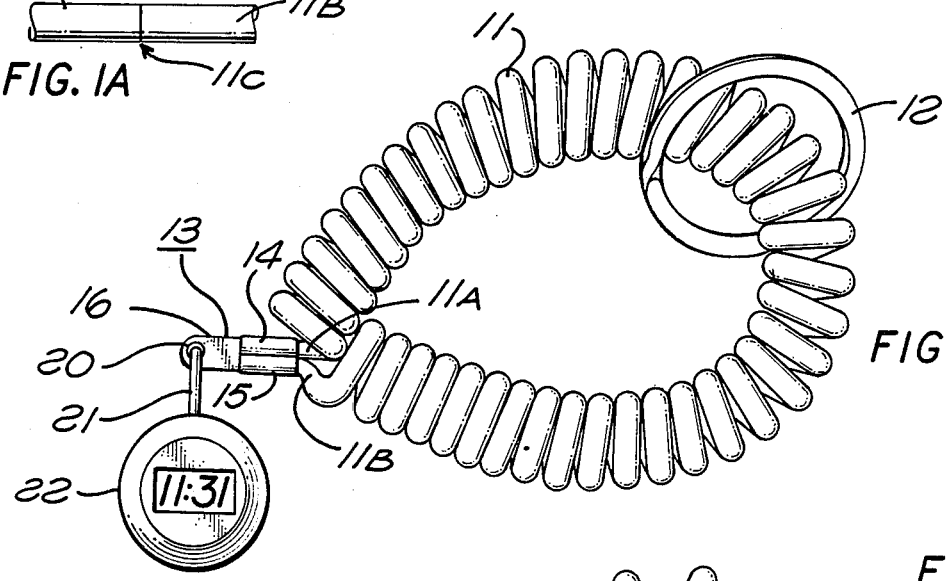
FIG. 2
FIG. 3
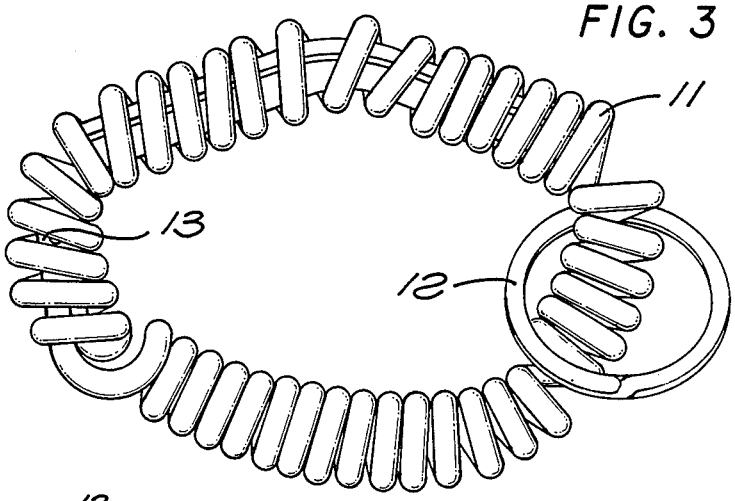
FIG. 1 PRIOR ART
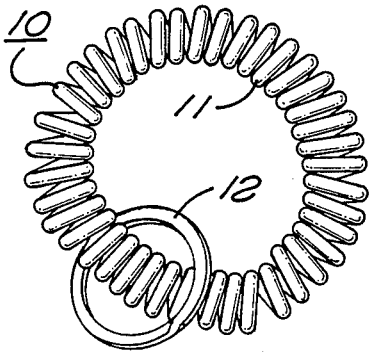
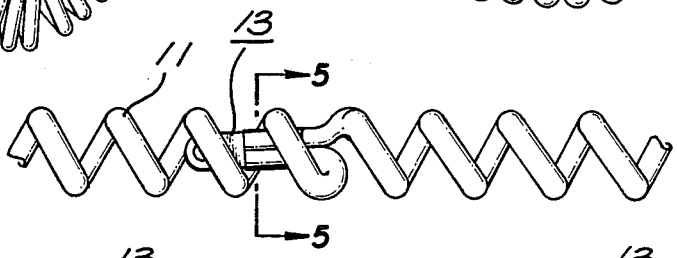
FIG. 4
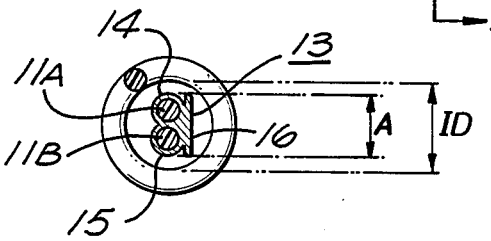
FIG. 5
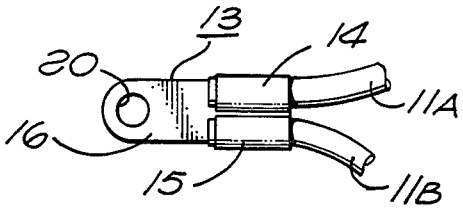
FIG. 6

RESILIENT WRIST BRACELET

BACKGROUND OF THE INVENTION

There is a continuing need for improved wrist or ankle bracelets particularly designed to carry at least one key on a ring. Common applications for such bracelets in the workplace are clerks or bank tellers who need to carry a single key at all times to allow them to unlock their cash drawer. In the recreational area there is a need for athletes, gymnasts and aerobic exercise students to carry their gym locker key where it is visible at all times and not requiring the presence of a pocket. Likewise, swimmers can use such a bracelet.

Coiled plastic spring bracelets have become quite popular for this purpose. Typically, they involve helical plastic extrusions which are continuous, cut into lengths of, for example, eight inches, a key ring slipped over one end of the helical plastic and the ends of the helical coils cemented or otherwise fused together to form a continuous helix. This provides the basic need for a prespiration impervious resilient plastic wrist bracelet.

I have found, however, that both the cost and reliability of such bracelets which are cemented or fused together at the ends are objectionable. The cost of the step of cementing or fusing the ends together is the most expensive step in the manufacture of the bracelets and the reliability and therefore, utility of the bracelet is in serious jeopardy if the joint fails.

Bracelets of the type I am discussing are often used to carry a valuable key. The possibility of loss of the key by failure of the cemented or fused joint outweighs the utility of the bracelet and presents a serious disadvantage to present bracelets.

BRIEF DESCRIPTION OF THE INVENTION

Faced with the foregoing, it occurred to me that it should be possible to join the ends of a helically wound coil section in a manner which is effective, low in cost and in no way detracts from the appearance of the otherwise continuous closed helical loop.

I determined that, from a reliability standpoint, the mechanical clamping of the ends of the helix together is far superior to cementing or fusing. The superiority results from significant reduction in cost, speed of manufacture and most particularly, reliability.

The difficulty with end clamps for bracelets and the like is that they are very obvious members which tend to detract from the appearance of the overall bracelet. It occurred to me that if it is possible to clamp the ends of the helical bracelet together and have the end member provide a useful function and, when not in use, be concealable, that a superior bracelet would be born.

I determined that a crimp connection of the general type used in the electronics field to terminate a cable wire into what is sometimes termed a spade lug or the like, would be a suitable general type of end connection for a bracelet.

I also determined that the crimp connector typically is longer than it is wide and if that width dimension were selected to be lesser than the internal diameter of the plastic helix at the end connector, that the connector, when not in use, can be inserted within adjacent turns of the coil and thereby concealed. The connector is totally enclosed within the turns, and therefore does not come into contact with the wearer's skin or any clothing. Whenever it is desired to carry a second and separate object such as a digital watch or identifying tag secured to the bracelet, the end connector can be slipped out of the coils and a ring passed through an opening in the tab portion of the connector. This is in addition to a regular key ring encircling the coils.

This dual use of the end connector in terminating both ends of the coil, acting as a connection point for objects to be carried or, when not in use, to be concealed within the coils, has significantly reduced the cost and at the same time, increased the utility of coiled bracelets.

BRIEF DESCRIPTION OF THE DRAWINGS

This invention may be more clearly understood by reference to the drawing in which:

FIG. 1 is an elevational view of the prior art of this invention;

FIG. 1A is a fragmentary view of FIG. 1 showing the connection of the ends of the prior art of this invention illustrated in FIG. 1;

FIG. 2 is an elevational view of a bracelet in accordance with this invention;

FIG. 3 is a front elevational view of this invention with the end tabs concealed and the coils being used as a storage place for paper documents such as a currency bill;

FIG. 4 is an expanded fragmentary section of the coil of FIG. 2 showing the storage of the end connector;

FIG. 5 is a vertical sectional view taken along line 5.5 of FIG. 4 and showing an end view of the stored end connector; and FIG. 6 is a fragmentary front elevational view of the attachment member of this invention.

DETAILED DESCRIPTION OF THE INVENTION

Refer now to FIG. 1 and FIG. 1A, which show a prior art type expandable helical plastic wrist or ankle bracelet of the type generally available. They include a continuous loop 11 of helically wound plastic which encircles a split key ring 12. Split key ring 12 is of the type which includes two turns of the helix of metal, generally semi-circular cross-section. A key may be inserted between one end and its adjacent turn and slipped around until it is fully enclosed and secured to the split ring 12. Thereafter, the bracelet 10 may be worn on the wrist and the key or keys are close at hand at all times. This type of bracelet has received wide acceptance. As indicated, one of the difficulties is that it has necessarily been made from a continuous helix of plastic which is cut into sections and the two ends fused or chemically bonded together as illustrated in FIG. 1A, in which ends 11A and 11B have been bonded together at joint 11C. The cost and reliability of forming such a joint has caused serious problems with bracelets of the type shown in FIG. 1.

Referring to FIG. 2, the improved bracelet of my invention may be seen employing a helix 11 of plastic material, such as polyethylene, in which a split ring 12 has been added. In this case, however, the two ends of the helix 11 designated 11A and 11B have been inserted into a crimped fastener 13, having a pair of rolled-over arms 14 and 15 and an end tab 16. The end tab has an opening 20 therethrough which receives a ring 21 supporting an additional object such as a digital clock 22. In such case the user has not only a key ring but a watch at his wrist at all times without danger of loss of either the key or the watch and with no danger of forgetting it in a jacket pocket.

Referring now to FIG. 3, one of the important advantages of this invention is illustrated in this view where the end connection 13 can be inserted in adjacent turns of the bracelet when the end tab is not in use. It is hardly visible and does not come into contact with the wearer's skin or clothing. In general, the bracelet has the same general appearance as the prior art bracelet of FIG. 1 but with added utility.

Refer now to FIG. 4 wherein it may be seen that the end connection 13 can easily be inserted within the spirals of the bracelet 11 when not in use so as to conceal the connection. FIG. 5 shows the end connection 13 stored within the helix 11 and of a width, A, smaller than the inside diameter, ID, of turn 11.

Refer now to FIG. 6, which shows the connection 13 consisting of an extension 16 with an opening 20 to support an object on a ring such as a digital clock. The connection has two rolled-over arms, 14 and 15, which define tunnel-like enclosures which surround and secure the ends of the helix, 11A and 11B respectively. The end tab 16 is aligned with the rolled arms 14 and 15 thereby maintaining the overall transverse dimension less than the inside diameter of the turns 13 of the helix forming the bracelet.

CONCLUSION

One can see that this invention has added utility as well as versatility over the prior art. It can be produced at a lesser cost and at the same time be more reliable.

What is claimed is:

1. A helical loop plastic bracelet comprising:

a helix length of substantially moisture impervious resilient material having a pair of ends and a central opening within the turns of said helix length of predetermined inside diameter;

a ring encircling said helix length providing a support for objects such as keys to be carried by said bracelet;

an end tab for joining said ends together to form a closed bracelet comprising an elongated body of deformable material such as metal defining a pair of passages for confining said ends in rigid relationship;

said end tab including an extension having a opening therethrough for securing an additional object to be carried on said bracelet;

said end tab having a maximum dimension transverse to the length of said elongated body less than the inside diameter of said helix length whereby said end tab may be stored within said helix when not in use carrying an object.

2. The combination in accordance with claim 1 in which said end tab is formed of metal.

3. The combination in accordance with claim 1 wherein said helix length is of polyethylene.

4. The combination in accordance with claim 1 wherein said end tab includes a pair of arms formed to define respective tunnel-like enclosures for the ends of said helix length and wherein said extension is aligned with said tunnel-like enclosures for the ends of said helix length.

* * * * *